US006093139A

United States Patent [19]

Belanger

[11] Patent Number: 6,093,139

[45] Date of Patent: Jul. 25, 2000

[54] FOLDING APPARATUS FOR ROTARY PRINTING PRESSES

[75] Inventor: Roger R. Belanger, Dover, N.H.

[73] Assignee: Heidelberger Druckmaschinen AG, Heidelberg, Germany

[21] Appl. No.: 09/013,930

[22] Filed: Jan. 27, 1998

[51] Int. Cl.[7] ..... B65H 45/16

[52] U.S. Cl. ..... 493/353; 493/426

[58] Field of Search ..... 493/353, 426, 493/427–435, 471, 476

[56] References Cited

U.S. PATENT DOCUMENTS

| | | | |
|---|---|---|---|
| 629,928 | 8/1899 | Seymour | 493/428 |
| 1,185,088 | 5/1916 | Goss et al. | 493/426 X |
| 1,413,841 | 4/1922 | Fallot | 493/426 |
| 1,900,288 | 3/1933 | Jordhoy | 493/431 X |
| 2,031,780 | 2/1936 | Lamatsch | 493/431 X |
| 3,195,882 | 7/1965 | Nystrand | 493/430 |
| 4,445,881 | 5/1984 | Bullen et al. | 493/427 X |
| 5,122,109 | 6/1992 | Kubota et al. . | |
| 5,503,071 | 4/1996 | Hillebrand et al. . | |

FOREIGN PATENT DOCUMENTS

| | | |
|---|---|---|
| 0 656 307 A1 | 6/1995 | European Pat. Off. . |
| 295 02 957 | 5/1995 | Germany . |
| 7-089670 | 4/1995 | Japan . |

*Primary Examiner*—David A. Scherbel
*Assistant Examiner*—Anthony Ojini
*Attorney, Agent, or Firm*—Burns, Doane, Swecker & Mathis, LLP

[57] ABSTRACT

The present invention is related to a product cutting device for flat material, such as sheets, webs of material or the like. A product folding cylinder rotates about an axis of rotation and has a surface for supporting the incoming material to be cut. A cutting cylinder cooperates with the product folding cylinder and has knife assemblies mounted thereon. Cyclically engageable product seizing elements are assigned to at least one of the product folding cylinder and the cutting cylinder, and are moveable opposite to a sense of rotation of the product folding cylinder. The product seizing elements engage a respective next product's front portion after the cutting operation is terminated.

21 Claims, 3 Drawing Sheets

1
2
3
4
5
6
7
8
9
10
11
12
13
14
15
16
17
18
18.1
19
20
21
23
37
i'

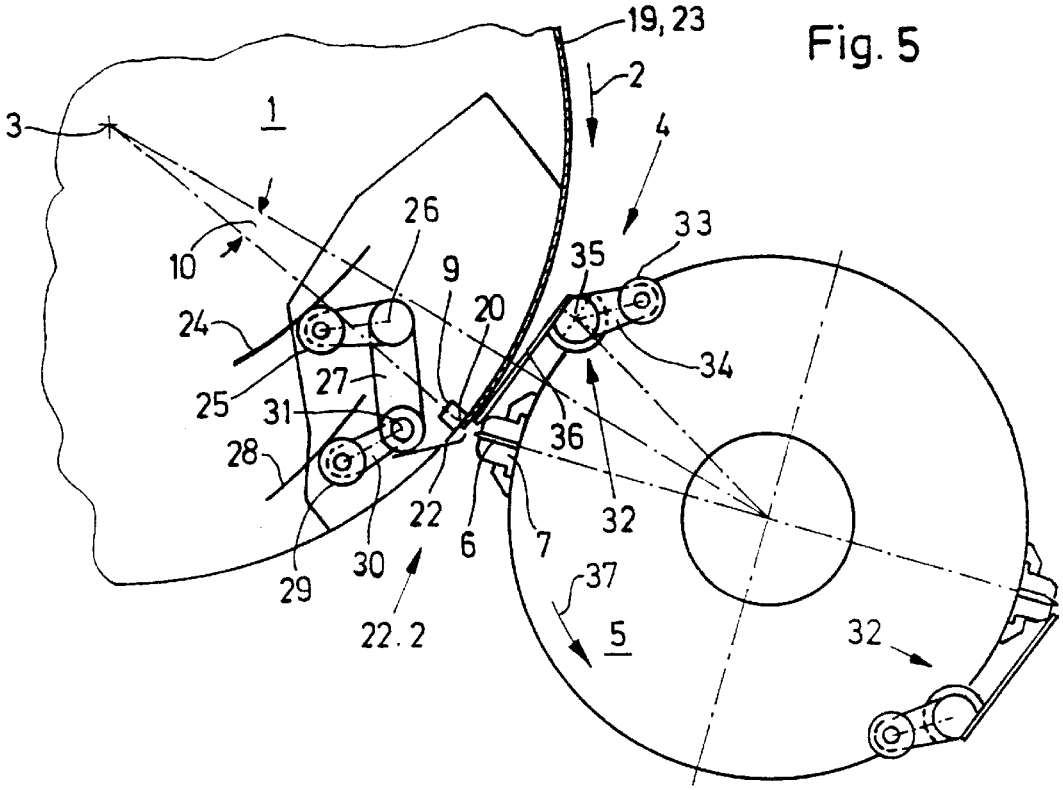
Fig. 5
Fig. 4
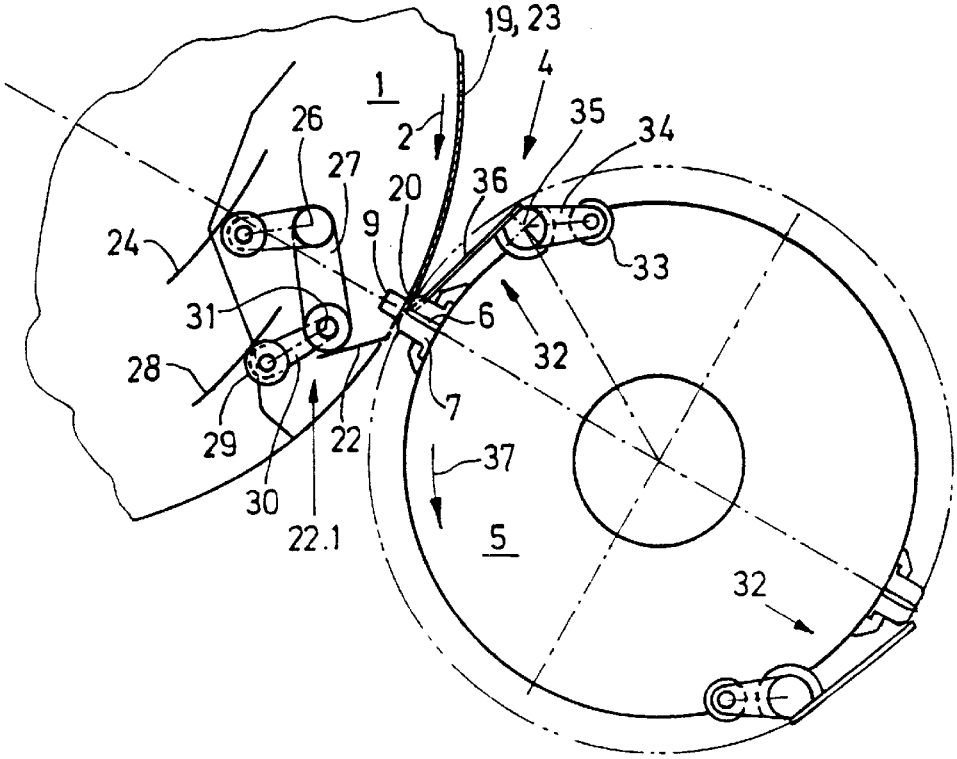

FOLDING APPARATUS FOR ROTARY PRINTING PRESSES

BACKGROUND OF THE INVENTION

1. Field of the Invention

The present invention relates to a pinless folding apparatus for rotary printing presses, particularly for web-fed rotary printing presses.

2. State of the Art

U.S. Pat. No. 5,122,109 is related to a folding drum in a folding machine for a rotary press. In a known folding drum of a folding machine for use with a rotary press, a web to be cut on the folding drum is guided and held by a plurality of parallel bands aligned in the axial direction of the folding drum and spanning a gap of the folding drum. Tips of a folding blade project to the outside of the folding drum through the gaps between the respective bands. At least two bands are integrally connected by a respective band mount position with a plurality of groups of such integrally connected bands being provided. Each band mount position is mounted to the folding drum via respective adjusting devices such that the expansion of the bands of each group of the folding drum can be adjusted. Preferably, each adjusting device includes an adjusting plate engaged with an adjusting rack to which the bands are mounted and an adjusting shaft. The adjusting plate is mounted to the adjusting shaft at an eccentric position with respect to its engagement with the adjusting rack.

DE 295 02 957.9 is related to a folding cylinder having an adjustable diameter. The effective diameter of a folding drum can be adjusted on the run to handle products of different product thicknesses. By means of a spindle which is arranged in the center of a folding drum and which is in cooperative engagement with further spindles, closer to the circumference of the folding drum, belts on the circumference can be moved relative to the folding drum. A disadvantage of this device is that a lot of mechanical components are necessary to create a relative motion of the belts arranged on the outside of the folding drum.

SUMMARY OF THE INVENTION

It is accordingly one object of the present invention to eliminate from pinless applications, such as newspaper folders, the use of tapes to maintain product contact to the surface.

A further object of the present invention is to eliminate pin holes, which are unappealing in the product.

A still further object of the present invention is to avoid marking in nonheatset applications by eliminating any overspeeding operation of product associated transport members.

According to the present invention a product cutting device for flat material comprises:

a product guiding cylinder rotating about an axis of rotation and having a surface supporting an incoming material;

a cutting cylinder cooperating with said product guiding cylinder and having knife assemblies mounted thereon; and at least one cyclically engageable product seizing element assigned to at least one of said product guiding cylinder and said cutting cylinder, and being moveable opposite to a sense of rotation of said product guiding cylinder for engaging a next product's front portion after a cutting operation.

The advantages resulting from exemplary embodiments of the present invention allow pinless folders to operate with even more paper-savings. Product seizing elements used with the present invention maintain exact signature registration after the cutting operation. A contact of the freshly cut signatures along a portion of their respective surface with belts or tapes is thus eliminated; i.e. the risk of damage to the signatures no longer is a threat to signature quality. A still further benefit of the present invention is that the product seizing elements do not apply any damage to the signatures such as pin holes or the like. Instead the product seizing elements only contact signatures within a very small rim thereof.

According to exemplary embodiments of the invention, the product seizing elements are arranged on a product guiding cylinder or for example on a cutting cylinder's surface. The product seizing elements either adopt an engaged or disengaged position with respect to the signatures transported on the cylinder. The product seizing elements are actuatable by a cam arrangement, or alternately by a spring arrangement. The engaged position of the product seizing elements is accomplished by superimposed motion of a transmission system arranged within a product guiding cylinder. In the transmission system a first lever moves about a first pivot axis and a second lever moves about a second pivot axis. By using the transmission system to engage and disengage the levers to move the product seizing elements opposite to the sense of rotation of the cylinder, then a further movement is effected about the second pivot axis to seize the respective next signature's front edge portion.

The first movement about the first pivot axis is effected by a first cam follower whereas the second movement about the second pivot axis is actuated by a second cam follower. An access window within which the respective new front edges of the signature are engaged by the product seizing elements extends up to 15° of a cylinder's revolution, or greater.

Further, a hold down device can be assigned to a cutting cylinder arranged in the vicinity of a knife assembly. The hold down device can either be actuated by, for example, a cam or by a spring arrangement.

The product cutting device can be mounted to a folding apparatus, which in turn forms an integral part of a web-fed rotary printing press.

A method for cutting flat material is disclosed as well.

BRIEF DESCRIPTION OF THE DRAWINGS

The above and still other features, objects and advantages of the present invention will become more apparent upon consideration of the following detailed disclosure of a specific embodiment thereof, when taken in conjunction with the accompanying drawing, wherein:

FIG. 4 shows an alternate embodiment of a product seizing element according to FIGS. 2, 3, the cutting cylinder having an additional hold down element; and FIG. 5 shows the additional hold down element engaging a respective front edge of a product, after the front edge has left the cutting area.

DETAILED DESCRIPTION OF PREFERRED EMBODIMENTS

Figure 1:
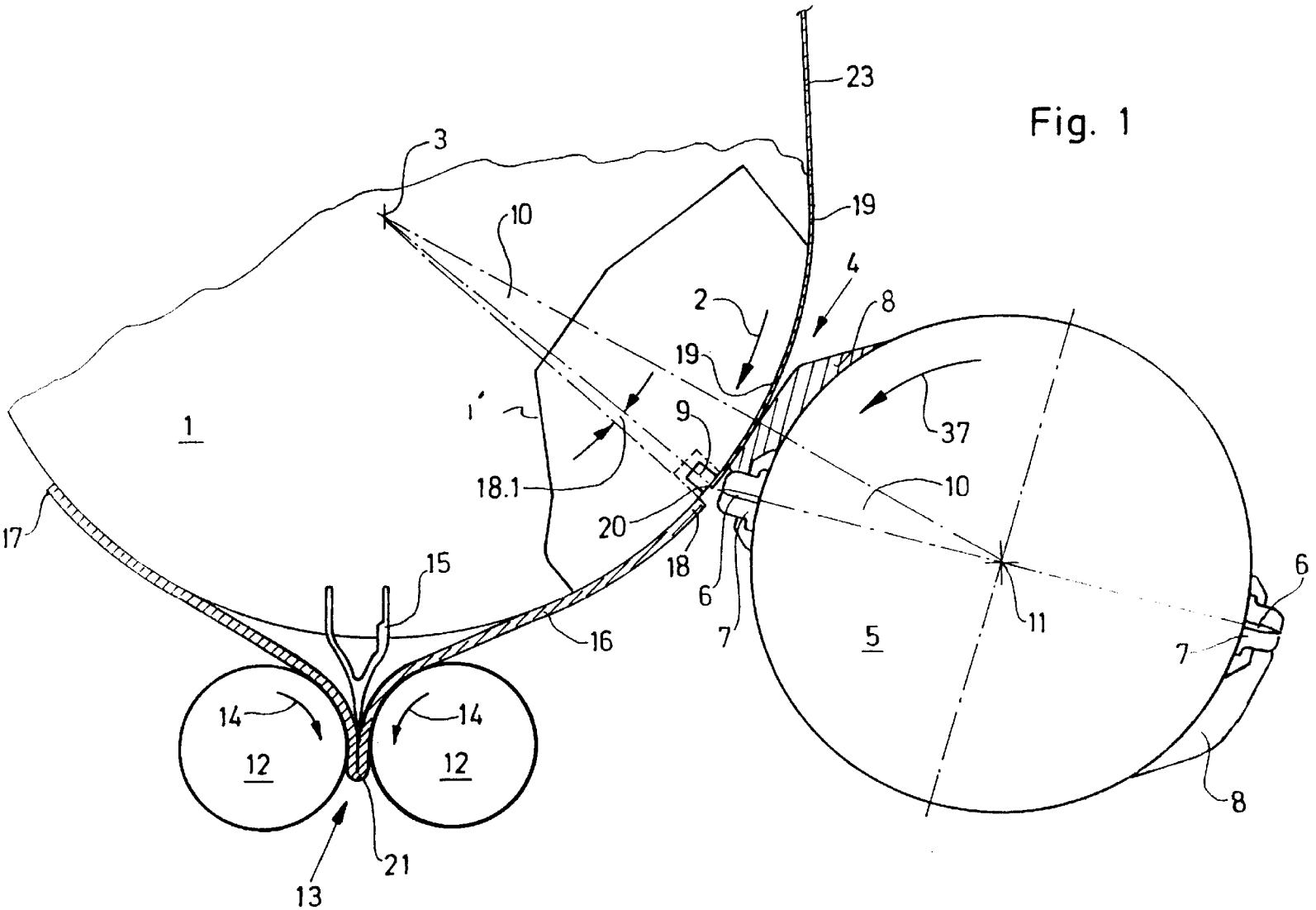
FIG. 1 shows an exemplary side elevation of a pair of cylinders, i.e. folding cylinder and a cutting cylinder cooperating therewith, the access area to the respective front edge of a next product being extremely small.

In FIG. 1 shows an exemplary side elevation of a pair of cylinders; i.e. product folding cylinder 1 and a cutting cylinder 5 cooperating therewith are shown. The access area 10 to the respective front edge of a next product 19 is extremely small.

In the folder apparatus, cutting cylinder 5 is assigned to the product folding cylinder 1. The product folding cylinder 1 receives an incoming web of material 23 from the leading edge of which signatures 16, 19 are severed. The cutting operation is performed in a transversal direction with respect to the direction of product transport. On the cutting cylinder 5 rotating about axis 11, knife assemblies 6 are arranged, each including cheekwoods 7 and a sponge pad 8. Between the surface of the product folding cylinder 1 and the cutting cylinder 5, a nip 4 is provided through which a respective sponge pad 8 passes, thus pushing the front portion of the respective web of material against the surface of a product folding cylinder 1.

Opposite knife assemblies 6, anvil bars 9 are provided on the circumference of the product folding cylinder 1. Upon cooperation of the knife assemblies 6 with anvil bars 9 on the product folding cylinder 1, a signature 16 is severed from the incoming web of material 23. The signature 16 has a front edge 17 and a trailing edge 18. In the example given in FIG. 1, the signature 16 is tucked by a tucking blade 15 into a fold roller nip 13 between two fold rollers 12 rotating at, for example, 10–20 percent or greater over the speed of the product folding cylinder and in a sense of rotation 14. The effect of the overspeed in fold rollers 12 produces a gap 18.1 between the trail edge 18 of signature 16 and the front edge of signature 19, a desirable effect on the trail edge 18. By tucking the product 16 into the fold roller nip 13, the product's fold, or backbone, 21 is formed. After a subsequent revolution of the cutting cylinder 5, the next knife assembly 6 will cooperate with another anvil bar 9, thus severing a subsequent signature 19 from the incoming web of material 23. The respective sponge pads 8 assigned to the knife assemblies 6 fix the portion of the respective web of material 23 within which the transversal cut finally will be performed. In the angular position of respective cylinders shown in FIG. 1, the respective sponge pad 8 mounted on the cutting cylinder 5 contacts the next product 19 to be severed from the incoming web of material 23.

Figure 2:
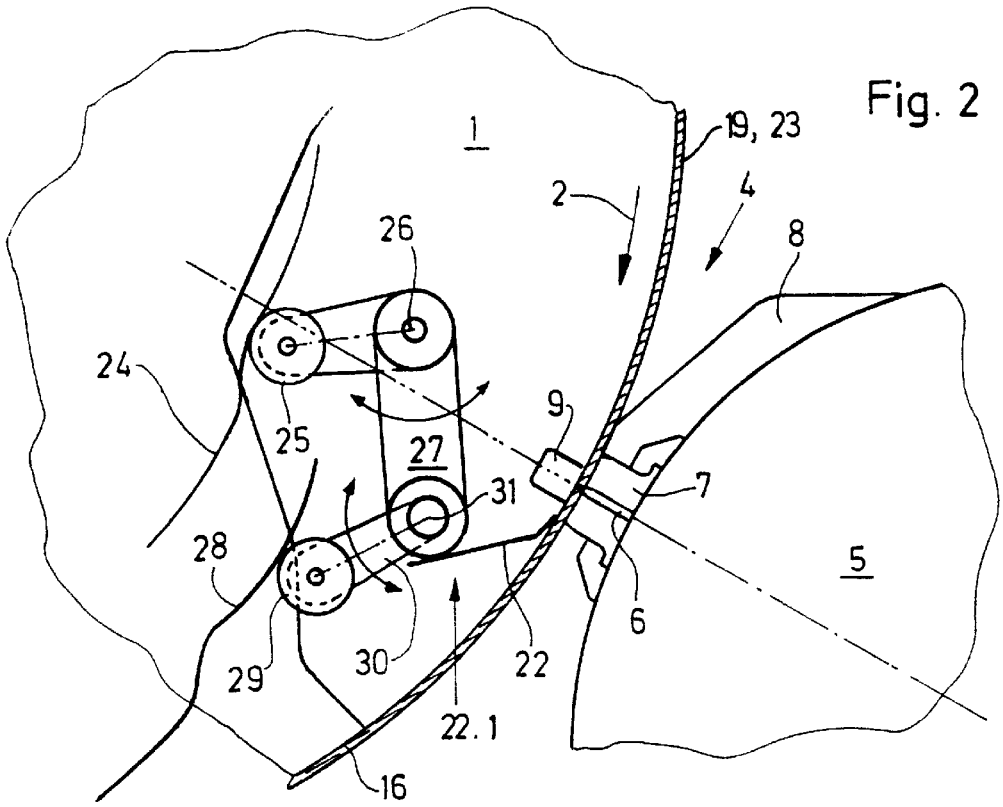
FIG. 2 shows a side elevation of a product seizing element integrated into a folding cylinder, the respective product seizing element being in its retracted position prior to the cutting of a passing web.

FIG. 2 is a side elevation of a product seizing element integrated into a recess 1' of product folding cylinder 1, the respective product seizing element being in its retracted position prior to the cutting of a passing web.

On the cutting cylinder 5, a knife assembly 6 is fastened between cheekwoods 7 to which a sponge pad 8 is assigned. Knife assembly 6 cooperates with an anvil bar 9 as previously discussed. Within the product folding cylinder 1, a product seizing element 22 is arranged in its retracted position 22.1. The product seizing element 22 is actuatable by a lever assembly 27, 30. In the interior (or exterior) of the product folding cylinder 1, two exemplary cams represented as a first cam 24 and a second cam 28 are contoured as shown in FIG. 2. For example, the cams can be arranged in recesses of cylinder 1 in a manner readily apparent to those skilled in the art so that cam followers associated therewith can achieve the operation described herein. A first cam follower 25 assigned to the first cam 24 moves a lever 27 about a first pivot axis 26. A second cam follower 29 assigned to the second cam 28 opens and closes the product seizing element 22 via a further lever 30 rotating about a second pivot axis 31. The product seizing element 22 leaves its retracted position 22.1 and moves out of the cylinder's interior to seize the front edge portion 20 (FIG. 3) of next product 19. By the respective first cam 24, the product seizing element 22 is subsequently moved upon the surface of cylinder 1 in a direction opposite to the sense of rotation 2.

In FIG. 2, the transversal cut of a respective next product 19 from a web of material 23 is accomplished when the knife 6 dives into a respective anvil bar 9 mounted on a product folding cylinder's 1 surface. This cutting line is given in FIG. 2 by the dashed line extending inclined through anvil bar 9 and knife assembly 6.

Figure 3:
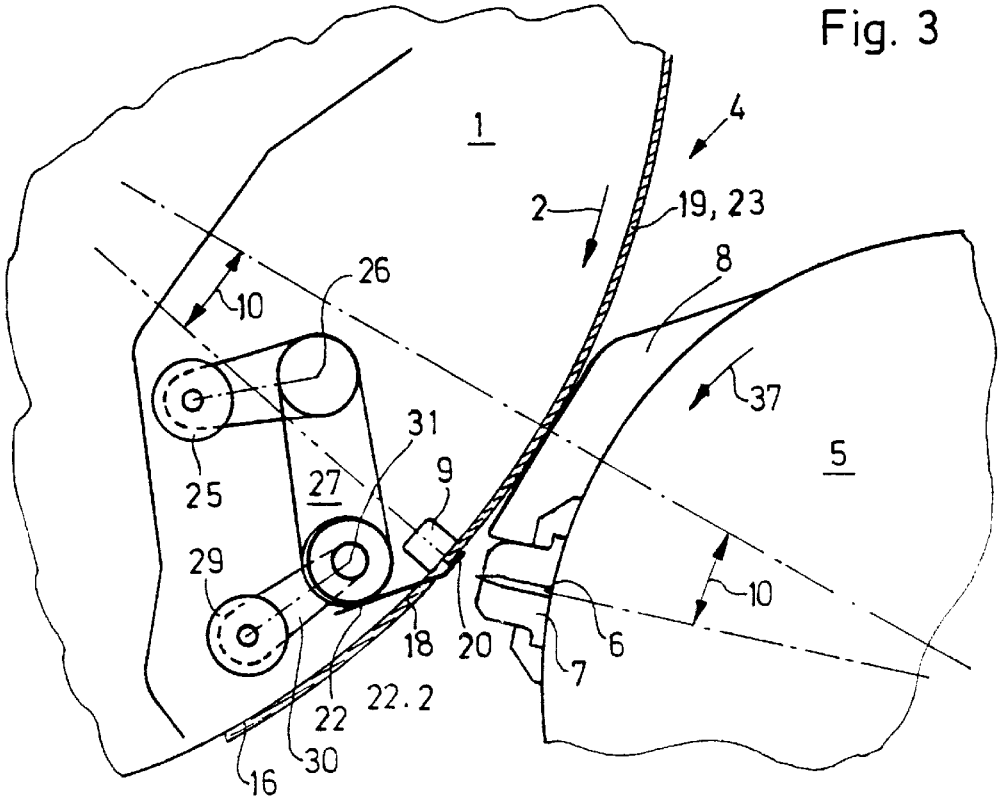
FIG. 3 shows a side elevation of a product seizing element in its engaged position, seizing a respective front edge of a respective next product.

As can be seen from FIG. 3 the product seizing element 22 has moved above a respective anvil bar 9 and seizes the respective front edge 20 of a next product 19, in response to actuation by the second cam 28 causing a movement of lever 30 about the second pivot axis 31. The respective next product 19 will be severed from the incoming web of material 23 by the next transversal cut performed by a knife assembly 6 cooperating with respective anvil bar 9. The lever assembly 27, 30 superimposes a rotational movement of lever 30 effected by the second cam 28 and rotational movement of a lever 27 about a first pivot axis 26 opposite to the sense of rotation 2 of the product folding cylinder 1. Thus, a secure seizing of the next product 19 is achieved.

In FIG. 3, a side elevation of a product seizing element in its engaged position is shown. Thus, seizing of a respective front edge portion of a respective next product is seen. In this state, the product seizing element 22 has seized a respective front edge 20 of a next product 19, which will be severed from the incoming web of material 23.

In FIG. 3, the final state, i.e. the seizing of a new front edge 20 of the next product 19, is shown which has to happen within the access window 10. The access window 10 extends from the previously mentioned inclined dashed lines within, for example, a range of about 10°–15° of revolution of cylinder 1 in the sense of rotation 2. Within this access window 10, the product seizing element 22 has to emerge from the interior of cylinder 1, move opposite the sense of rotation 2 of the pair of cylinders 15, overlap the respective new front edge 20 of the next product 19, and finally seize the front edge 20 to maintain the signature's proper registration on the surface of cylinder 1.

In the state of cylinder rotation given in FIG. 3, the afore-mentioned sponge pad 8—given as an example here—contacts the forward portion of a next product 19. However, since the respective product's front edge 20 is now being seized by respective seizing element 22, the sponge pad 8 is no longer necessary and therefore can be optionally omitted from the given configuration. In FIG. 3, the product seizing element 22 has adopted an engaged position 22.2 seizing the front edge 20 of a next product 19 actuated by a second cam follower 29. In order to temporarily fix the front edge 20 of next product 19 on the surface, the second cam 28 keeps the product seizing element 22 in its engaged position 22.2. The first cam follower 25 and actuating cam 24 keep the position of lever 27 constant to prevent it from further movement about the first pivot axis 26. Thus, the registration of the next product 19 on the cylinder's surface is achieved. In FIG. 3 the outer curvatures of the respective curves 24, 28, as shown in FIG. 2, have been omitted for reasons of clarity.

The front edge 20 of a respective next product 19 front edge 20 is seized by the product seizing element 22. In the state given in FIG. 3, the product seizing element 22 is kept in position, i.e. its engaged position 22.2, by the respective second cam follower 29. Since the knife assembly 6, upon further rotation of the cutting cylinder 5, rotates out of the nip 4, a collision between engaged product seizing element 22 and the respective knife cylinder 6 is avoided. Consequently, an actuation of the product seizing element 22 to engage a front edge 20 of a respective next product 19 is phased to begin within the access window 10. The product seizing element 22 will move onto the surface of the product folding cylinder 1. The product seizing element 22 will move from under the trailing edge 18 of product 16 onto the top of the front edge 20 of the next product 19. Due to the overspeed of fold rollers 12 in FIG. 1, the product's trailing edge 18 is advanced from its cut point, creating gap 18.1 and allowing room for seizing element 22 to move out from under the product 16 with minimum disturbance to trailing edge 18.

FIG. 4 shows an alternate embodiment of a product seizing element according to FIGS. 2 and 3, wherein the cutting cylinder 5 has an additional hold down element. FIG. 4 depicts a product folding cylinder 1, which receives an incoming web of material 23 from which a next product 19 has to be severed. The product seizing element 22 is given in its retracted position 22.1. The knife assembly 6 cooperating with an anvil bar 9 has cut a preceding signature from a web of material 23. The interior of the product folding cylinder 1 is similar to the interior of the product folding cylinder 1 described earlier in connection with FIGS. 2 and 3 respectively. In the present embodiment, a cutting cylinder 5 is equipped with two knife assemblies 6 arranged on its circumference. Both knife assemblies 6 have an assigned hold down arrangement. In its disengaged position, a hold down element 32 is in a retracted state contacting a cheekwood 7 of a respective knife assembly 6. The hold down element 32 includes a pivot axis 35 about which the hold down element 32 turns into its engaged position. The pivot axis 35 is actuatable via a lever 34 to which a cam follower 33 is mounted. In the state given in FIG. 4, the respective knife assembly 6 has cut a preceding signature transversely from an incoming web of material 23. The line of the cut is depicted as in FIG. 2 with a dashed line extending through anvil bar 9 and knife assembly 6. In the state given in FIG. 4, the product seizing element 22 as well as the hold down element 32 stay in their respective retracted positions. The envelope curve of the hold down element 32 is likewise depicted in a dashed circle.

FIG. 5 shows the additional hold down element engaging a respective front edge of a product after the front edge has left the cutting area. In this state, both the product seizing element 22 and the hold down element 32 adopt their respective engaged positions to seize a next product's front edge 20. As previously described, the product seizing element 22 dives out of the interior of product folding cylinder 1 actuated by cam 24, cam follower 25, and lever 27. By the first rotational movement of lever 27 about the first pivot axis 26, the product seizing element 22 moves opposite to the sense of rotation 2 of the product folding cylinder 1. By means of the second cam 28, the second cam follower 29 effects a second rotational movement of the product seizing element 22 around a second axis of rotation 31. Thus, the product seizing element 22 seizes a small portion of the respective new front edge 20 of a next product 19.

Likewise, a cam follower 33 on the cutting cylinder 5 effects a movement of a hold down element 32 opposite to the sense of rotation 37 of the cutting cylinder 5. The tip of hold down element 32 moves opposite to the sense of rotation 2, 37 respectively, in order to press the respective front edge 20 against the surface of a product folding cylinder 1. Again this movement is phased to be accomplished within the access window 10 of cylinder revolution. Prior to seizing the respective front edge of a next product 19, the hold down element 32 contacts the next product 19 by turning about the respective pivot axis 35, actuated by the cam follower arrangement 33, 34. Thus, the front edge 20 of the next product 19 can be secured until the product seizing element 22 seizes the respective front edge 20 thereof. The upper surface of the hold down element 32 will contact the next product's surface upon common rotation of the product folding cylinder 1 and the cutting cylinder 5.

Instead of the sponge pad 8, other features such as, for example, O-shaped rings extending over the circumference of the cutting cylinder 5 can be used. In addition, the cutting cylinder 5 can be arranged, for example, in the 2 o'clock position instead of the 4 to 5 o'clock position shown in the respective drawings of FIGS. 2 to 5. Instead of the one anvil bar shown in the two embodiments given here, a plurality thereof can be mounted on the circumference of the respective product folding cylinder 1.

With the seizing system according to the present invention having two pivot points, a folder for newspapers can, for example, be run in straight mode and/or in collect mode. There is no maintenance required for belts and tapes because those parts have been eliminated; paper-saving can thus be achieved, because pin holds are eliminated. Shorter product lengths can be realized as well.

It will be appreciated by the skilled in the art that the present invention can be embodied in other specific forms without departing from the spirit of the essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Product cutting device for flat material comprising:

a pinless product folding cylinder rotating about an axis of rotation and having a surface supporting an incoming material;

a cutting cylinder cooperating with said product folding cylinder and having knife assemblies mounted thereon; and at least one cyclically engageable product seizing element assigned to at least one of said product folding cylinder and said cutting cylinder, and being moveable opposite to a sense of rotation of said product folding cylinder for engaging a next product's front portion after a cutting operation.

2. Product cutting device according to claim 1, wherein said product seizing element is arranged on said product folding cylinder.

3. Product cutting device according to claim 1, wherein said product seizing element is arranged as a hold down device on said cutting cylinder.

4. Product cutting device according to claim 3, wherein said hold down device is assigned to at least one of said knife assemblies on said cutting cylinder.

5. Product cutting device according to claim 3, wherein said hold down device is actuated by a cam.

6. Product cutting device according to claim 3, wherein said hold down device is spring actuated.

7. Product cutting device according to claim 3, wherein said at least one cyclically engageable product seizing element further includes:

a hold down device on said cutting cylinder.

8. Product cutting device, according to claim 1, wherein said product seizing element cyclically adopts an engaged position and a disengaged position.

9. Product cutting device according to claim 1, wherein said product seizing element is actuated by a cam arrangement.

10. Product cutting device according to claim 1, wherein said product seizing element is actuated by a spring arrangement.

11. Product cutting device according to claim 1, wherein said product seizing element engages said front portion of said next product by superimposed motion of a lever system.

12. Product cutting device according to claim 11, wherein a first lever of said lever system moves about a first pivot axis.

13. Product cutting device according to claim 12, wherein a second lever of said lever system moves about a second pivot axis.

14. Product cutting device according to claim 13, wherein said product seizing element opens to an engaged position by said second lever prior to a movement of said product seizing element opposite to said sense of rotation by said first lever.

15. Product cutting device according to claim 11, wherein a first movement about said second pivot axis is effected by a first cam follower.

16. Product cutting device according to claim 11, wherein a second movement about said second pivot axis is effected by a second cam follower.

17. Product cutting device according to claim 1, wherein an access window extends within a range of 10° to 15° over a cylinder revolution.

18. Folder apparatus comprising at least one fold roller in operative communication with a product cutting device having:

a pinless product folding cylinder for flat material, said product folding cylinder rotating about an axis of rotation and having a surface supporting an incoming material;

a cutting cylinder cooperating with said product guiding cylinder and having knife assemblies mounted thereon; and cyclically engageable product seizing elements assigned to at least one of said product folding cylinder and said cutting cylinder, and being moveable opposite to a sense of rotation of said product guiding cylinder for engaging a next product's front portion after a cutting operation.

19. Rotary printing press comprising a product cutting device having:

a pinless product folding cylinder for flat material, said product folding cylinder rotating about an axis of rotation and having a surface supporting an incoming material;

a cutting cylinder cooperating with said product folding cylinder and having knife assemblies mounted thereon; and at least one cyclically engageable product seizing elements assigned to at least one of said product folding cylinder and said cutting cylinder and being moveable opposite to a sense of rotation of said product folding cylinder for engaging a next product's front portion after a cutting operation.

20. Method for cutting flat material according to claim 19, further comprising the step of:

clamping said next product's front portion by an actuated hold down element arranged on a surface of said cutting cylinder.

21. Method for cutting flat material comprising the steps of:

rotating a pinless product folding cylinder about an axis of rotation, said product folding cylinder having a surface supporting an incoming material;

cooperatively rotating a cutting cylinder with said product folding cylinder, said cutting cylinder having knife assemblies mounted thereon; and moving at least one cyclically engageable product seizing element, assigned to at least one of said product folding cylinder and said cutting cylinder, opposite a sense of rotation of said product folding cylinder for engaging a respective next product's front portion after a cutting operation.

* * * * *

US006093139C1

(12) EX PARTE REEXAMINATION CERTIFICATE (6103rd)

United States Patent
Belanger

(10) Number: US 6,093,139 C1
(45) Certificate Issued: Jan. 22, 2008

(54) FOLDING APPARATUS FOR ROTARY PRINTING PRESSES

(75) Inventor: Roger R. Belanger, Dover, NH (US)

(73) Assignee: Heidelberger Druckmaschinen AG, Heidelberg (DE)

Reexamination Request:
No. 90/007,260, Oct. 21, 2004

Reexamination Certificate for:

| | |
|---|---|
| Patent No.: | **6,093,139** |
| Issued: | **Jul. 25, 2000** |
| Appl. No.: | **09/013,930** |
| Filed: | **Jan. 27, 1998** |

(51) Int. Cl.
*B65H 45/16* (2006.01)
*B65H 45/28* (2006.01)

(52) U.S. Cl. ..... 493/353; 493/426
(58) Field of Classification Search ..... 493/353, 493/426, 424, 434
See application file for complete search history.

(56) References Cited

U.S. PATENT DOCUMENTS

| | | | |
|---|---|---|---|
| 629,928 | A | 8/1899 | Seymour |
| 953,063 | A | 3/1910 | Sheldon |
| 1,185,088 | A | 5/1916 | Goss et al. |
| 1,413,841 | A | 4/1922 | Fallot |
| 1,900,288 | A | 3/1933 | Jordhoy |
| 2,031,780 | A | 2/1936 | Lamatsch |
| 3,195,882 | A | 7/1965 | Nystrand |
| 4,445,881 | A | 5/1984 | Bullen et al. |
| 5,122,109 | A | 6/1992 | Kubota et al. |
| 5,484,379 | A | 1/1996 | Stab |
| 5,503,071 | A | 4/1996 | Hillebrand et al. |

FOREIGN PATENT DOCUMENTS

| | | |
|---|---|---|
| DE | 295 02 959.9 | 5/1995 |
| EP | 0 656 307 A1 | 6/1995 |
| JP | 07-089670 | 4/1995 |

*Primary Examiner*—Christopher Harmon

(57) ABSTRACT

The present invention is related to a product cutting device for flat material, such as sheets, webs of material or the like. A product folding cylinder rotates about an axis of rotation and has a surface for supporting the incoming material to be cut. A cutting cylinder cooperates with the product folding cylinder and has knife assemblies mounted thereon. Cyclically engageable product seizing elements are assigned to at least one of the product folding cylinder and the cutting cylinder, and are moveable opposite to a sense of rotation of the product folding cylinder. The product seizing elements engage a respective next product's front portion after the cutting operation is terminated.

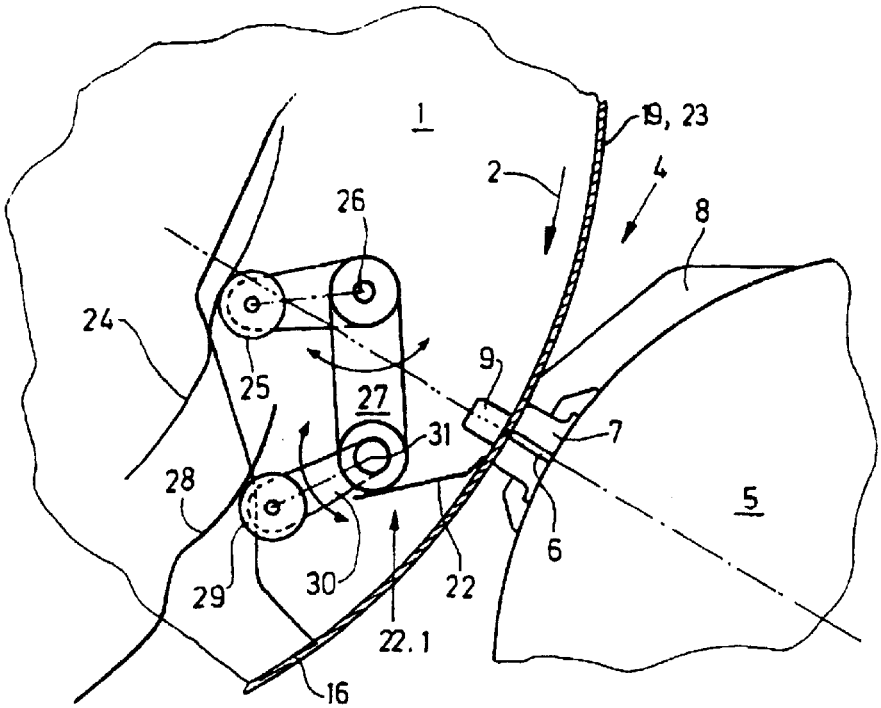

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–21 are cancelled.

* * * * *